United States Patent [19]

Kohl

[11] 4,049,161

[45] Sept. 20, 1977

[54] ICE MAKING AND VENDING MACHINE

[75] Inventor: Vance L. Kohl, Albert Lea, Minn.

[73] Assignee: King-Seeley Thermos Co., Ann Arbor, Mich.

[21] Appl. No.: 630,045

[22] Filed: Nov. 7, 1975

Related U.S. Application Data

[63] Continuation of Ser. No. 437,468, Jan. 28, 1974, abandoned.

[51] Int. Cl.[2] ..... F25C 1/04

[52] U.S. Cl. ..... 222/233; 222/146 C; 222/369; 222/508; 194/2

[58] Field of Search ..... 222/146 C, 226, 233, 222/236, 238, 239, 242, 504, 508, 369, 234; 194/2; 192/2, 142, 144; 62/381; 221/200, 203, 266

[56] References Cited

U.S. PATENT DOCUMENTS

| | | | |
|---|---|---|---|
| 2,149,044 | 2/1939 | Clouse | 192/144 |
| 2,295,258 | 9/1942 | Cann | 222/369 X |
| 2,334,965 | 11/1943 | Thacker | 192/144 X |
| 3,272,300 | 9/1966 | Hoenisch | 194/2 |

*Primary Examiner*—Robert B. Reeves
*Assistant Examiner*—Joseph J. Rolla
*Attorney, Agent, or Firm*—Harness, Dickey & Pierce

[57] ABSTRACT

The ice making and vending machine of the present invention will be seen to minimize to the extreme any ice bridging or fusing within the ice storage bin by virtue of the unique design and relationship of the bin rotor to the configuration of the bin. Additionally, the ice making and vending machine of the present invention will be seen to be extremely positive in operation in assuring that ice cubes are not delivered to the dispensing cavity of the machine housing except during such time as the vend switch is actuated, with the brake arrangement associated with the drive motor functioning to positively position the rotor at the termination of each vend cycle. It will be noted that the brake mechanism will function in two directions so as to not only prevent forward rotation of the rotor at the termination of a vend cycle but will also prevent rearward rotation as might occur when the rotor is subjected to certain loading conditions due to the quantity and orientation of the cubes within the bin. Still another feature of the present invention resides in the fact in those instances when supplemental ice agitation is desired, a unique shutter arrangement may be employed so as to permit such agitation to be achieved by means of the ice dispensing rotor, thereby obviating the need for any ancillary ice agitating equipment as has occasionally been required in the art.

8 Claims, 11 Drawing Figures

ICE MAKING AND VENDING MACHINE

This is a continuation, of application Ser. No. 437,468, filed Jan. 28, 1974 now abaondoned.

BACKGROUND OF THE INVENTION

U.S. Pat. No. 3,272,300, issued Sept. 13, 1966, discloses an automatic ice vending machine of the type for selectively producing and vending or dispensing preselected quantities of ice, such as ice cubes. It is the practice in ice making and vending machines of the type shown in the aforementioned patent to periodically replenish the quantity of ice cubes within the ice storage bin by means of an automatic ice cube manufacturing or making apparatus which is normally disposed interiorly of the machine cabinet. Due to the dispensing of ice cubes from the storage within the machine and the periodic replenishment thereof, the quantity of ice cubes within the bin will vary over a period of time from a maximum amount under a fully loaded condition to a minimum amount under near empty condition, depending upon the demand and the time required to replenish the ice supply.

One particular problem which was solved, at least to some degree of satisfaction in the aforementioned U.S. Pat. No. 3,272,300, and to which the subject matter of the present application is at least in part directed, is the tendency of the ice cubes within the storage bin to adhere and become fused to one another. Such fusing is commonly referred to as ice "bridging". Ice bridging is typically overcome by providing some type of ice agitating means within the ice storage bin which causes a certain degree of movement of the ice cubes at timed intervals, whereby to prevent the ice cubes from fusing to one another; however, due to the fact that the ice cubes are relatively fragile and it is desirable to dispense the same with a minimum amount of breakage, it is highly desirable to minimize such agitation to the extreme, particularly in view of the fact that agitation of the ice cubes results in an increased meltage rate and may also cause premature machine attrition. A related problem of ice agitation is caused by the fact that it is extremely difficult to effect agitation of all of the ice cubes stored within a particular ice storage bin. Thus, even though an agitating means is utilized in a storage bin, it is frequently the case that only a portion of the ice cubes are moved during the agitation cycle, with the remaining cubes being subjected to fusing or bridging.

The present invention is directed toward a new and improved ice making and vending machine which is similar in overall function to the machine shown in the aforementioned patent; however, the present invention embodies a number of improved features which minimize to the extreme, the possibilities of ice bridging so that ice may be dispensed in a uniform, sanitary manner without being subjected to excess breakage or ice fusion, and it is the general object of the present invention to provide a new and improved ice making machine with such features.

It is a more particular object of the invention to provide a new and improved ice vending machine which includes an ice storage bin and dispensing rotor or drum which are so designed as to minimize cube bridging.

It is another object of the present invention to provide a new and improved ice vending machine having an improved construction promoting cleanliness and sanitation. Toward this end, the present invention includes an ice storage bin which is fabricated of a molded polymeric material that may be easily cleaned.

It is still another object of the present invention to provide a new and improved ice vending machine which features a unique shutter arrangement for blocking ice flow between the ice storage bin and an ice discharge chute and adapted to be used when periodic agitation of the ice dispensing drum occurs.

It is another object of the present invention to provide a unique braking arrangement on the drive motor which functions to selectively rotate the ice dispensing drum whereby to positively position the drum at the termination of each ice vend cycle.

It is still another object of the present invention to provide a new and improved ice vending machine which is adapted to provide for the dispensing of uniform quantities of ice during each vend cycle.

It is still a further object of the present invention to provide a new and improved ice vending machine that is of a relatively simple design, and which will have a long and effective operational life.

Other objects and advantages of the present invention will become apparent from the following detailed description taken in conjunction with the accompanying drawings.

BRIEF DESCRIPTION OF THE DRAWINGS

FIG. 6 is an enlarged cross-sectional view of the ice dispensing drum embodied in the ice making and vending machine of the present invention;

DESCRIPTION OF THE PREFERRED EMBODIMENTS

For purposes of the description, the term ice "cube", as used herein, is intended to be generic to a wide variety of ice products and is not intended as a geometrical limitation. Similarly, the terms "inwardly", "outwardly 38, "upwardly", "downwardly", "forwardly", "rearwardly" and various derivatives thereof are in no way intended to limit the scope or fair meaning of the present invention and have been utilized in the following description merely for purposes of indicating the relative positions of the various components of the present invention.

Figure 1:
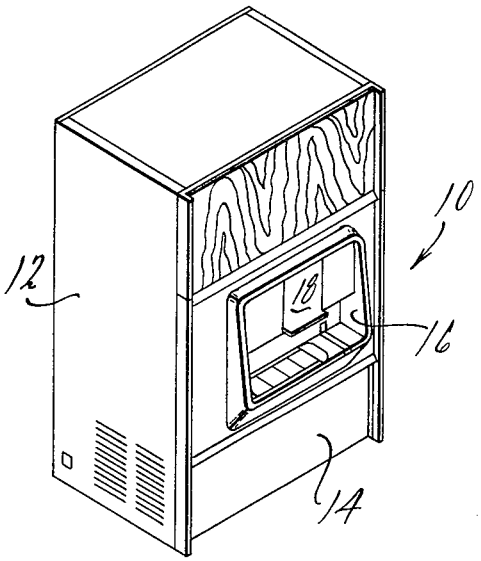
FIG. 1 is an elevated perspective view of the ice making and vending machine in accordance with the principles of the present invention.

Referring now in detail to the drawings and in particular to FIG. 1 thereof, an ice making and vending machine, generally designated by the numeral 10, is shown as comprising a generally parallel-piped head shaped upright housing or enclosure 12 having a forward or front face 14 within which an ice dispensing cavity 16 is provided. The cavity 16 is communicable via an ice delivery chute later to be described, with an ice dispensing assembly disposed within the housing 12 a position generally intermediate the upper and lower ends thereof. Disposed above the ice dispensing assembly 50 is an ice making apparatus, generally designated by the numeral 22, within which ice cubes are formed and are dropped downwardly into the ice dispensing assembly 20 for subsequent dispensing to the dispensing cavity 16. Disposed below the ice dispensing assembly 20 is a refrigeration system, generally designated by the numeral 24, comprising the unual compressor 26, condenser 28 and an evaporator 30, the latter of which is operatively associated with a combination evaporator and ice forming assembly in the ice making apparatus 22. the compressor 26, condenser 28 and evaporator 30 are operatively connected via conventional refrigeration conduits and are operatively associated with a refrigerant dryer 32 and an accumulator assembly, generally designated by the numeral 34. As will be appreciated by those skilled in the art, the refrigeration system 24 functions such that gaseous refrigerant at relatively high pressure is supplied by the compressor 26 to the condenser 28, the refrigerant being cooled and liquified as it passes through the condenser 28. The thus cooled and liquified refrigerant flows from the condenser 28 to the evaporator 30 where the refrigerant is vaporized by the transfer of heat thereto from the water which is being formed into ice within the ice making apparatus 22. The gaseous refrigerant then flows from the evaporator 30 back to the inlet or suction side of the compressor 26 for recycling.

Together with constituting part of the refrigeration system 24, the aforementioned combination evaporator and ice forming assembly comprises part of the water system of the ice making and vending machine 10 of the present invention, which water system is generally designated herein by the numeral 36. The system 36 is adapted to be communicable with a suitable source of fresh potable water, representatively designated by the conduit 38 in FIG. 11. The conduit 38 is communicable with an electrically operated solenoid valve assembly 40 which may be of any conventional construction adapted to be selectively actuated in response to an electrical signal for opening and closing a flow path to the conduit 38. The valve assembly 40 is communicable with a water heating tank 42 via a suitable supply conduit or line 44. The water heating tank 42 is in turn communicable via a water line 46 with a three-way water valve assembly, generally designated by the numeral 48, the construction and operation of which are described in U.S. Pat. application Ser. No. 190,234, filed Oct. 18, 1971, now U.S. Pat. No. 3,791,163. The water valve 48 is communicable with a water reservoir 50 within the ice making apparatus 22 via a suitable water line or conduit 52. The conduit 52 is also communicable with a water pump 54 which functions to pump water from the reservoir 50 to a water spray bar 56 via a water line or conduit 58. As will hereinafter be described, the spray bar 56 causes water to be directed upwardly toward an ice forming platen 60 wherein ice cubes to be dispensed by the machine are formed. The platen 60, as shown in FIG. 11, is communicable with the aforementioned conduit 46 and also includes a water overflow means by which may be directed into the reservoir 50, as will hereinafter be described.

Figure 3:
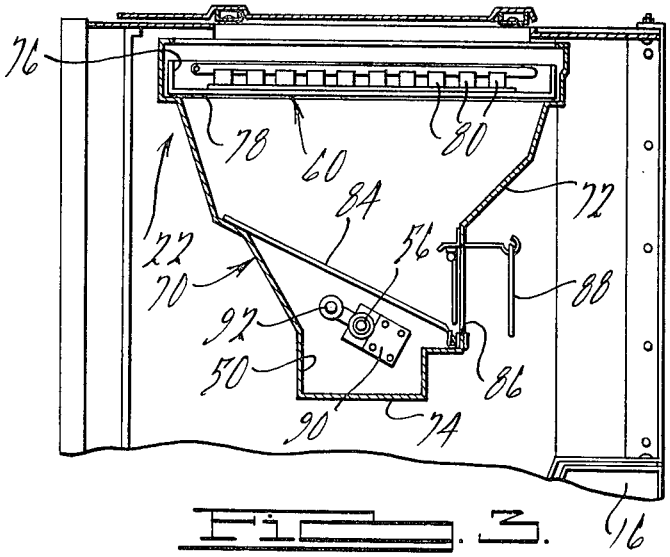
FIG. 3 is an enlarged fragmentary cross-sectional view taken substantially along the line 3—3 of FIG. 2.

Referring now in detail to the ice making apparatus 22, as best seen in FIG. 3, the apparatus is located within the upper end of the housing 12 and includes an inner housing 70 comprising downwardly converging side walls 72 which terminate at their lower ends in a bottom section 74 that defines the water reservoir 50. The platen 60 is disposed within the upper end of the inner housing 70 and comprises upstanding side walls 76 and a bottom section 78 which are cooperable to retain a quantity of water within the platen 60 for purposes hereinafter to be described. The refrigerant evaporator 30 is disposed within the upper end of the platen 60 and consists of a length of refrigerant conduit or tubing which is arranged in a generally serpentine configuration and is located in heat transfer relation to a plurality of inverted ice forming cups or molds 80 which face downwardly toward the interior of the inner housing 70 and are adapted to have water sprayed interiorly thereof by means of the aforementioned water spray bar 56. A water overflow, generally designated 82 (see FIG. 11), is disposed within the platen 60 and is adapted to communicate water in excess of a predetermined volume therewithin downwardly into the water reservoir 50. Disposed below the plurality of ice forming cups 80 is a downwardly inclined ice grate, generally designated 84, against which ice formed within the mold 80 is adapted to drop during the harvest portion of the operational cycle of the machine 10. The grate 84 is intended to cause the ice cubes to be deflected out of the housing 70 through a suitable discharge opening or the like 86 formed in the side wall 72 thereof, means in the form of a suitable ice deflecting screen or the like 88 being provided to cause the ice to drop downwardly into the ice dispensing assembly 20 which is disposed directly therebelow. Any excess water which may be on the surface of the ice cubes as they drop downwardly from the molds 80 upon the grate 84 will fall through the grate 84 into the water reservoir 50, as will be apparent. Disposed directly below the grate 84 is the aforementioned water spray bar 56 which is adapted to be oscillated back and forth by means of a suitable electrically energized motor or the like 90 which is operatively connected to the spray bar 56 by means of suitable operating linkages or the like, generally designated by the numeral 92. The spray bar 56 is provided with a plurality of upwardly directed water spray jets or nozzles 94 which are intended to direct water upwardly toward the inverted mold 80 upon operation of the spray bar 56.

Figure 11:
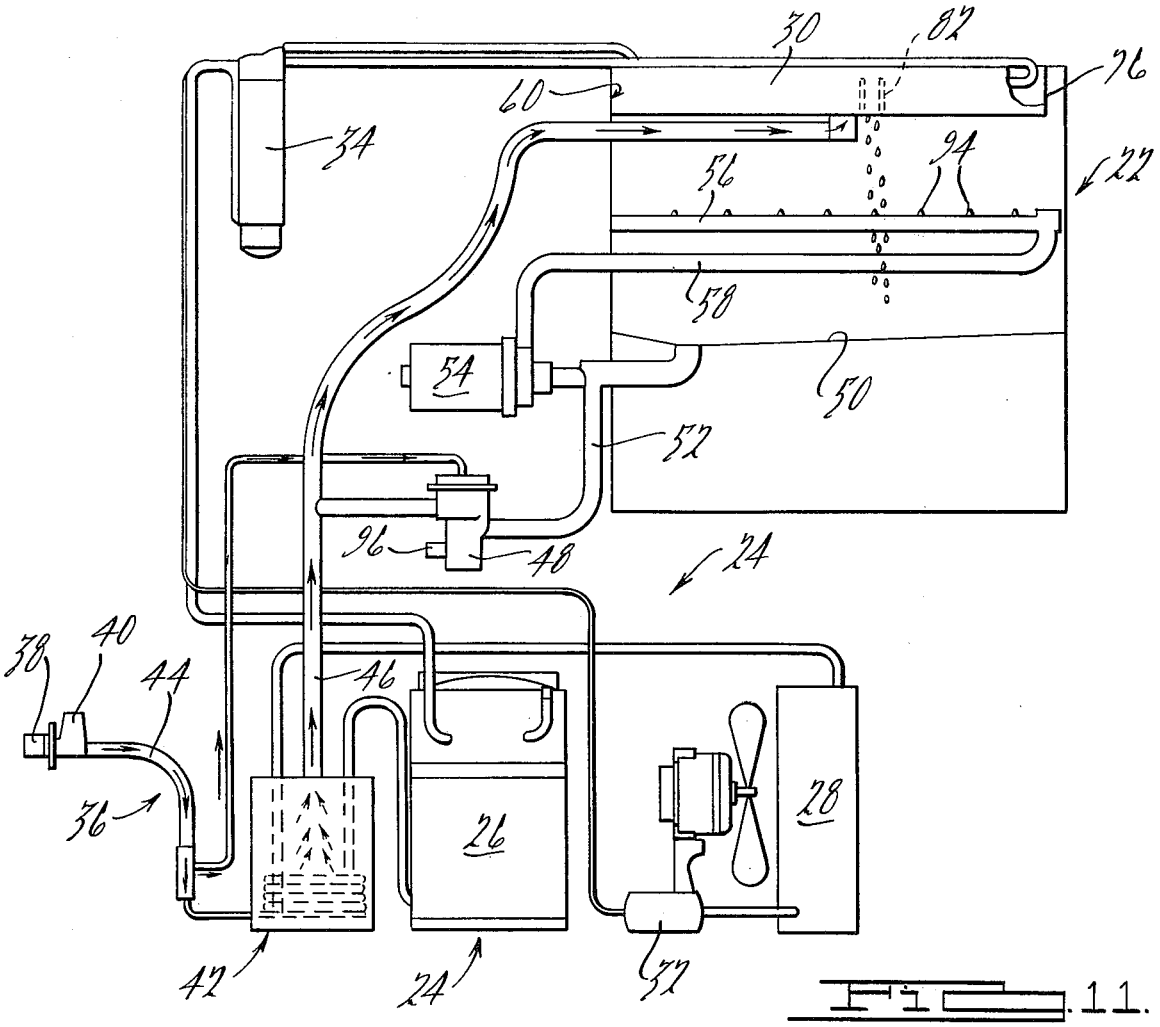
FIG. 11 is a schematic representation of the refrigeration and water systems incorporated in the present invention.

In operation of the apparatus 22 incorporated in the ice making and dispensing machine 10, assuming the initial condition that the plurality of ice molds 80 are empty; that the water reservoir or sump 50 contains a quantity of make-up water to be used in forming ice within the molds 80; that the water heating tank 42 contains a quantity of water to be heated in preparation for the next harvest portion of the operational cycle;

that the valve assembly 48 is actuated so as to block fluid flow between the reservoir 50 and the drain, representatively designated by the numeral 96 in FIG. 11, and permitting fluid flow between the platen 60 and the reservoir 50; further assuming that the solenoid valve assembly 40 is connected to the water source 38 and that the motor 90 associated with the spray bar 56 is energized so as to effect operation of the spray bar 56 and that the water pump 54 is operable to pump water from the reservoir 50 to the spray bar 56, and finally assuming that an associated ice level control mechanism within the ice dispensing assembly 20 is actuated so as to call for additional supply of ice to be transferred thereinto, the freezing cycle of the ice making apparatus 22 is initiated by energization of the refrigerator compressor 26. As the compressor 26 is energized, refrigerant will be forced to the refrigerator condenser 28 and thereafter to the evaporator 30 associated with the ice forming cups or molds or molds 80. Simultaneously, the spray bar 56 will be oscillated below the plurality of molds 80 and the water pump 54 will force water upwardly through the jets or nozzles 94, with the result that water will be directed into the open under sides of the molds 80. As a result of the water being thus sprayed into the molds 80 and normal operation of the refrigeration system 24, ice cubes will begin to form within the molds 80, with any excess water from the jets 94 dropping downwardly and falling into the reservoir 50. During this time, water within the water heating tank 42 will be heated by the refrigerant passing through the coiled conduit disposed therein which is in communication with the condenser 28 and compressor 26, preparatory to the next successive harvest portion of the operational cycle.

After the freezing portion of the cycle has progressed for a predetermined length of time, which time may be controlled by the temperature and pressure conditions of the evaporator 30, as is well known in the art, the freezing portion of the operational cycle will terminate and the harvest portion of the cycle will be initiated.

At the initiation of the harvest portion of the cycle, the valve assembly 48 will be actuated so to block fluid flow from the platen 60 to the reservoir 50. Simultaneously, fluid flow will be provided between the reservoir 50 and the drain 96 and water will be communicated from the valve assembly 48 to the water heating tank 42, with this water forcing the water which has previously been heated during the freezing portion of the cycle through the conduit 46 into the platen 60. As the warm water enters the platen 60, it will flow around the upper sides of the molds 80, thereby thawing the outer surfaces of the cubes formed therewithin and effecting the release of the cubes from the molds 80, whereby the cubes will drop downwardly upon the grate 84 and will be deflected through the opening 86 and against the screen 88, where the cubes will drop downwardly into the ice dispensing assembly 20 hereinafter to be described. During the harvest portion of the cycle, water will be retained within the platen 60 by virtue of the actuated position of the valve assembly 48. At the completion of the harvest portion of the cycle and initiation of the next successive freezing portion of the cycle, the valve 48 will be actuated in a manner such that water that was retained within the platen 60 will be communicated to the reservoir 50 where this water will constitute the make-up water for the ice cubes which are to be formed during the next freezing cycle. It is contemplated that the water system incorporated in the ice making and vending machine 10 will incorporate a feature disclosed in the aforementioned U.S. Pat. No. 3,791,163, wherein the spray bar 56 and water pump 64 will continue to operate during the harvest cycle as well as during the freezing cycle. The reason for this, as described in the aforementioned copending application, is that the spraying of water on the under sides of the cubes formed during the harvest cycle substantially decreases the harvest time since the water effects a faster release thereof than would occur if operation of the spray bar 56 and water pump 48 were discontinued during the harvest portion of the operational cycle.

Figure 2:
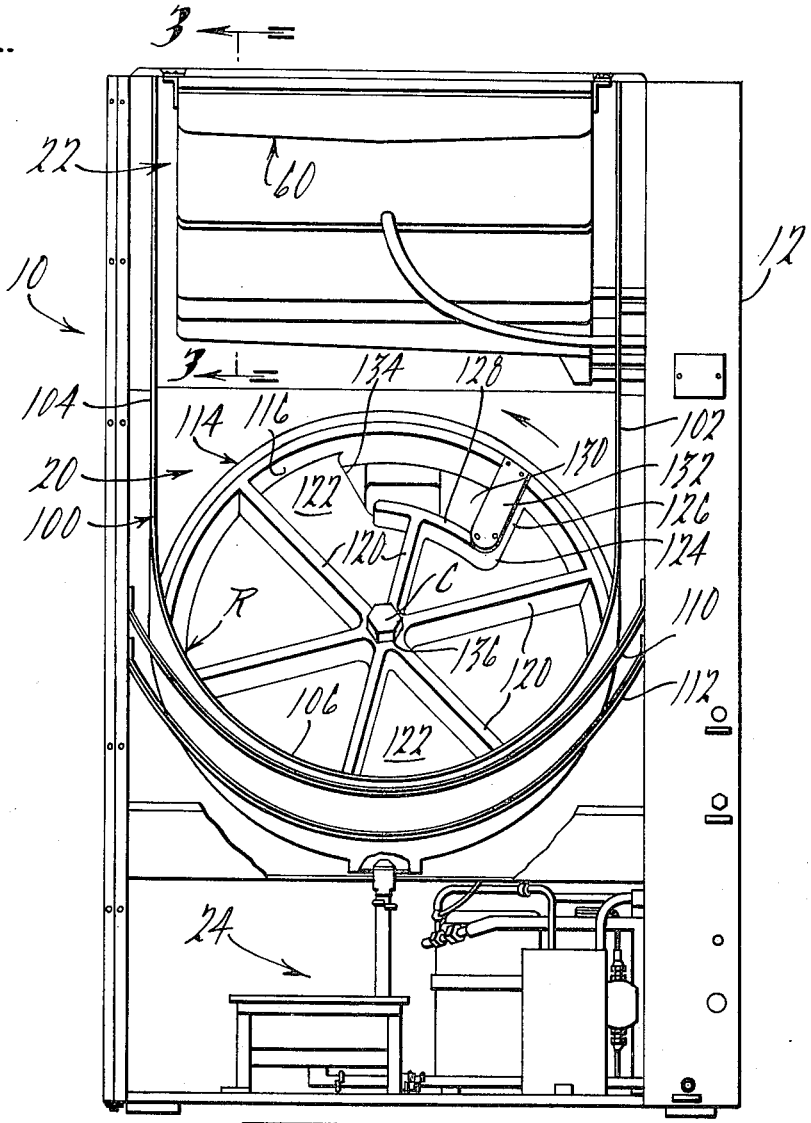
FIG. 2 is a longitudinal cross-sectional view of the machine depicted in FIG. 1.
Figure 4:
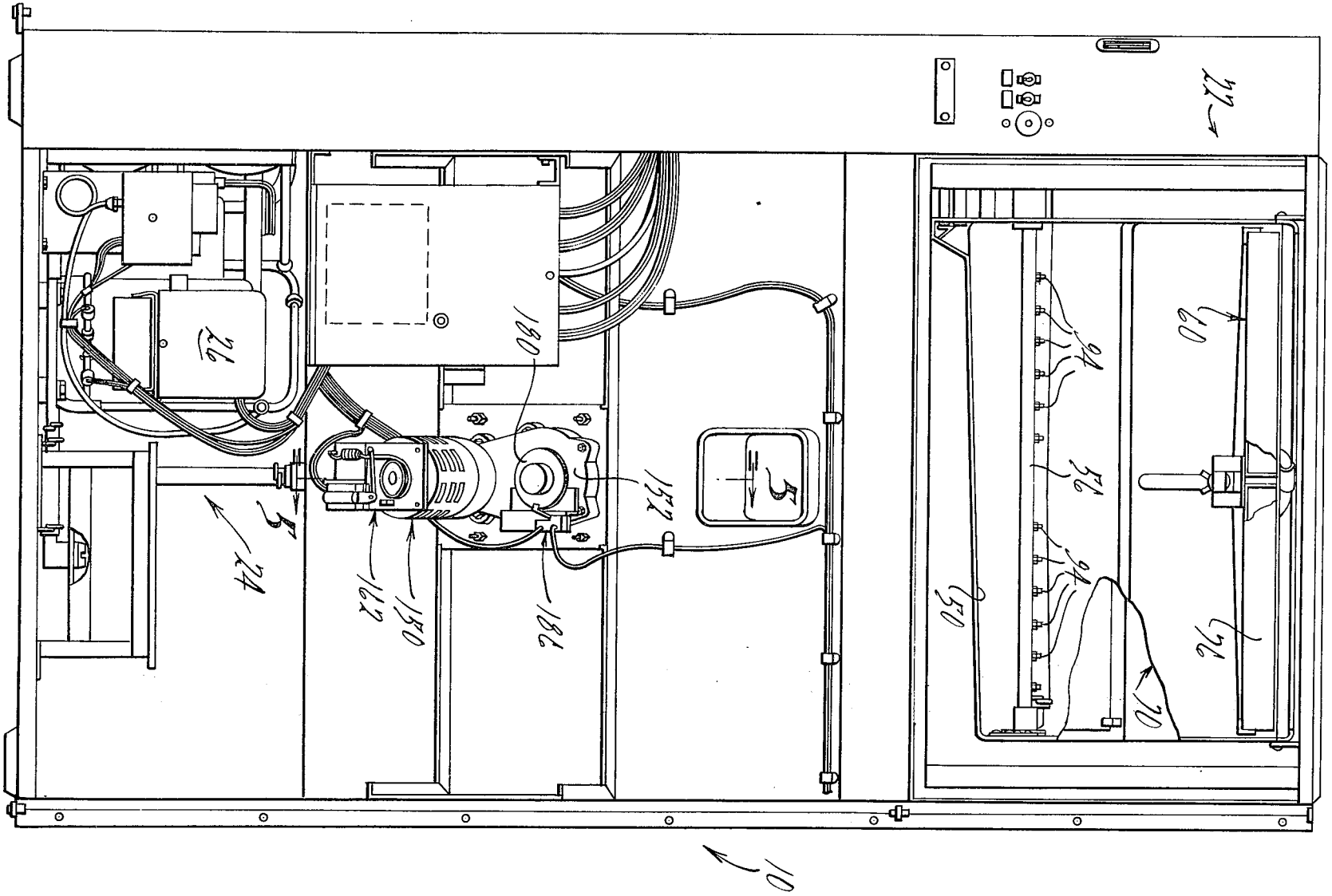
FIG. 4 is another longitudinal cross-sectional view of the ice making and vending machine of the present invention.
Figure 5:
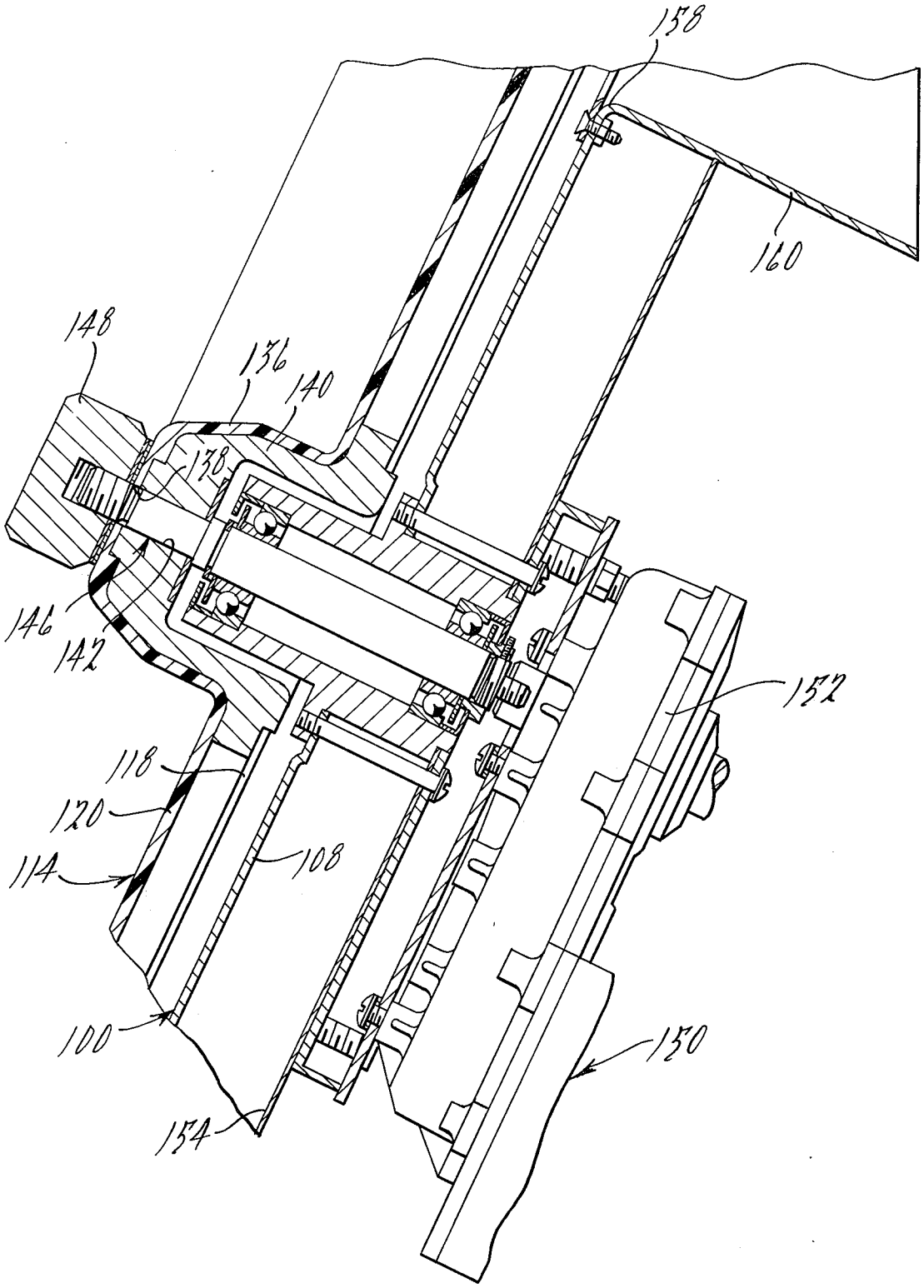
FIG. 5 is an enlarged fragmentary cross-sectional view taken along the line 5—5 of FIG. 4.
Figure 7:
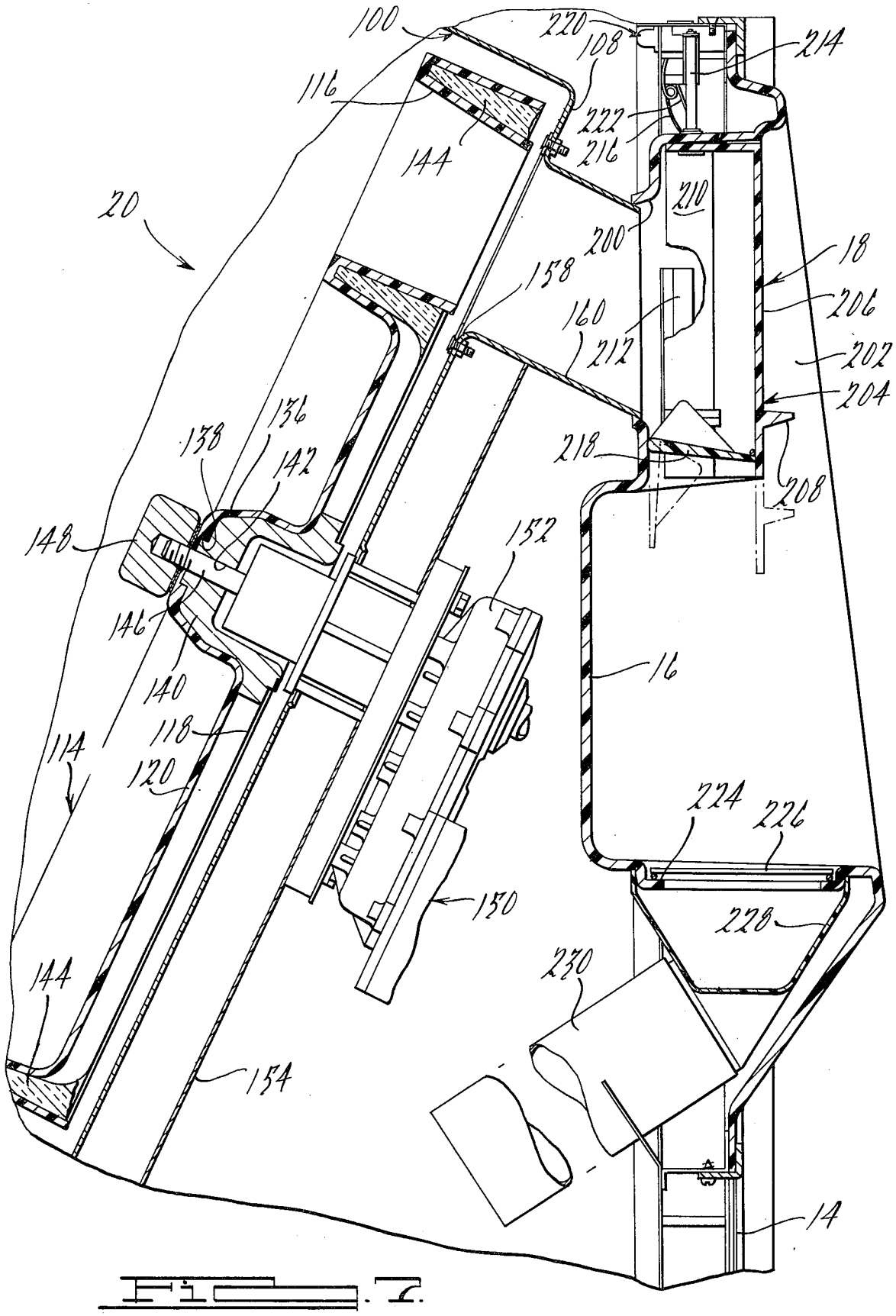
FIG. 7 is an enlarged fragmentary cross-sectional view of the dispensing drum, discharged chute and dispensing cavity of the ice making and vending machine of the present invention.

Referring now in detail to the construction and operation of the ice dispensing assembly 20, as best seen in FIG. 2, the assembly 20 includes an inner bin, generally designated by the numeral 100, which comprises a plurality of upstanding vertical side walls, two of which are shown in FIG. 2 and designated by the numerals 102 and 104. The side walls of the bin 100 extend upwardly from a position above the refrigeration system 24 to a position adjacent the upper end of the housing 12, as illustrated. Disposed at the lower end of the bin 100 is a generally arcuate-shaped lower end section, generally designated 106 which, as shown in FIG. 2, is of a generally semi-circular configuration defined by an imaginary circle having the side walls 102, 104 generally tangent thereto and having its center at the point C in FIG. 2 and having a radius equal to the distance R, as depicted in this figure. In other words, the diameter of this imaginary circle is approximately equal to the lateral spacing between the walls 102 and 104. As best seen in FIG. 7, the lower end of the bin 100 is also defined by a generally flat forwardly and upwardly inclined side section 108 which, together with the arcuate-shaped lower end section 106 defines an ice storage area within which ice cubes formed within the molds 80 are adapted to accumulate and be dispensed in a manner hereinafter to be described. The lower end of the bin 100 is supported within the housing 12 by means of a pair of generally strap-like elements 110 and 112 which extend transversely of the housing 12 and are connected at the opposite ends to the laterally opposite side wall thereof, as best seen in FIG. 2. The bin 100 is preferably, although not necessarily, fabricated of a suitable synthetic polymeric material, such as polyethylene, which may be easily cleaned and is particularly adapted to be molded by well known techniques to provide an extremely economical construction. Alternatively the bin 100 may be fabricated of stamped metal components such as, for example, stainless steel or aluminum which has the requisite sanitary and corrosion resistant characteristics.

As best seen in FIG. 7, the upwardly and forwardly inclined side section 108 is arranged directly interiorly or rearwardly of the ice dispensing cavity 16. Disposed directly inwardly from the side section 108 is an ice dispensing drum or rotor, generally designated by the numeral 114. As best seen in FIGS. 2, 6 and 7 the rotor 114 is of a generally circular configuration and has an outside diameter approximately equal to but slightly smaller than the lateral spacing between the side walls 102 and 104. In addition, the center of the rotor 114 is generally coincident with the center C and the radius of the rotor 114 is approximately equal to or slightly smaller than the radius R defining the lower end section 106 of the bin 100. Also, the rotor 114 is arranged generally parallel to the side section 108, with the result that when the rotor 114 is operatively positioned in the manner best shown in FIG. 2, the rotor 114 conforms generally to the shape of the lower end section 106 and has the upstanding side walls 102, 104 of the bin 100 arranged generally tangentially thereto. As best seen in FIG. 6, the rotor 114 includes an annular rim or side wall section 116 and a generally circular-shaped bottom section 118 which is coextensive within the rim 116. The bottom section 118 is formed with a plurality of generally radially disposed rib or spoke portions, generally designated by the numeral 120, which project outwardly from the bottom section 118 in the same direction as the rim section 116 and define therewith a plurality of generally pie-shaped recesses, generally designated by the numeral 122. One of the rib portions 120 is formed at the radially outer end thereof with a generally L-shaped section, generally designated 124, consisting of a radially outwardly extending portion 126 and a generally circumferentially extending portion 128 (see FIG. 2). The rib portions 126, 128 define a scoop area, generally designated 130. The downstream end (as defined by the direction of rotation of the rotor 114 in FIG. 2) is provided with a cover plate or the like 132 which functions to retain ice cubes within the scoop area 130 upon rotation of the rotor 114 in the manner hereinafter to be described. The bottom section 118 within the scoop area 130 is formed with a generally rectangular-shaped discharge opening 134 which functions in a manner hereinafter to be described in communicating ice cubes from the rotor 114 to the dispensing cavity 16. The rotor 114 includes a central outwardly projecting section 136 that is formed with a central opening (see FIG. 7) 138 and within which a hub member 140 is disposed. The hub member 140 is in turn formed with a central opening 142 which functions in a manner hereinafter to be described in operatively securing and supporting the rotor 114 within the bin 100. The rotor 114 is preferably fabricated of a suitable synthetic polymeric material, such as polyethylene, which is reinforced on the under side thereof by means of a suitable filler material, as indicated at 144 in FIG. 7, composed, for example, of a composition of zonolite and a compatible resin. The rotor 114 is preferably formed with smooth radius corners in order to promote cleanliness.

The rotor 114 is rotatably mounted in the position best shown in FIG. 7 wherein the bottom section 118 thereof is disposed in spaced paralellism relative to the side section 108 of the bin 100. The rotor 114 is rotatably supported in this position by means of a drive shaft 146 which extends through the openings 142 and 138 in the hub 140 and central portion 136 of the rotor 114. The outer end of the shaft 146 is externally threaded and is adapted to threadably receive a suitable retaining nut or the like 148 for fixedly securing the rotor 114 upon the shaft 146. The shaft 146 is drivingly connected with a suitable electrically energized drive motor, generally designated by the numeral 150, via a suitable speed reducing gear box or mechanism 152 which functions in a manner well known in the art in controlling the rotational speed of the shaft 146 and hence the rotor 114 upon energization of the motor 150. The motor 150 is operatively supported upon a support plate or the like 154 disposed on the opposite side of the bin section 108 from the rotor 114, as best seen in FIG. 7. Upon energization of the motor 150, the rotor 114 will rotate to a position wherein the opening 134 therein is aligned or registers with an opening 158 formed in the bin side section 108, which opening 158 is communicable via an ice discharge conduit 160 with the dispensing cavity 16 of the machine housing 12, as will hereinafter be described. In Accordance with one of the important features of the present invention, the need for periodically agitating the ice cubes disposed within the bin 100 is, under normal operating circumstances, eliminated by virtue of the relationship of the shapes of the rotor 114 and bin 100. More particularly, by virtue of the fact that the lower end section 106 of the bin 100 is of a semi-circular configuration and conforms to and is of the generally same shape as the rotor 114, the possibility of ice bridging or fusing within the bin 100 is minimized to the extreme. The reason for this is that normal rotational movement of the rotor 114 itself will be sufficient to cause movement of the cubes within the bin so that bridging thereof will be virtually eliminated provided that the machine 10 periodically undergoes a vend cycle. By virtue of the fact that there are no remote corners or recesses within the bin 100 which would normally be unaffected by rotation of the rotor 114 and hence would not be subjected to the agitating effect of the rotor 114, the rotor movement alone will usually prevent ice bridging. That is, if the bin 100 were of a generally rectangular configuration with the rotor mounted in the lower end thereof, the possibility of ice cubes disposed within the remote corners of such a rectangular bin not being subjected to agitation during cycling of the rotor 114 would be extremely great and hence objectionable fusing or bridging of the ice cubes within such remote corners would more than likely occur. By so designing the lower end section 106 of the bin 100 to have a radius R which is approximately equal to the radius of the rotor 114 and by locating the center of rotation of the rotor 114 at the center C of the imaginary circle whose radius is equal to the dimension R, the possibility of ice accumulating and eventually becoming fused or bridged together in remote corners of the bin 100 is minimized to the extreme.

Figure 8:
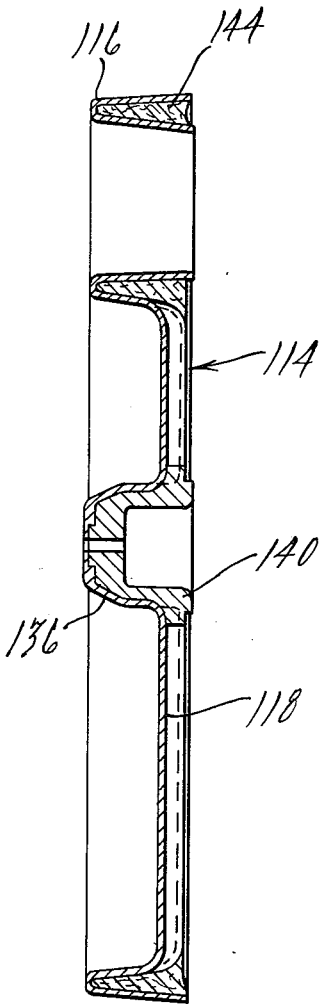
FIG. 8 is an enlarged side elevational view, inverted for purposes of clarity, of the drive motor and associated braking mechanism and cam control element which cooperates with the dispensing drum of the ice vending machine of the present invention.

In accordance with another feature of the present invention, the drive motor 150 for operatively rotating the rotor 114 is provided with means for positively stopping or terminating rotational movement of the rotor 114 at preselected positions. Such means is best shown in FIG. 8 and is shown as comprising a braking assembly, generally designated by the numeral 162. The assembly 162 is mounted adjacent the motor 150 and includes a disc 164 which is rotatably carried upon the output shaft of the motor 150 and is intended to rotate concomitantly therewith. Associated with the disc 164 is a brake band which is fabricated of a relatively flexible material and is herein designated by the numeral 166. The band 166 is fixedly secured at one end thereof by means of a suitable support or attachment bracket 168, with the band 166 extending around approximately one-half the circumference of the rotor 164 to a position wherein the opposite end thereof from the bracket 168 is attached to an actuating arm 170 of an electrically energized solenoid 172. The arm 170 is spring-biased by means of a suitable coil spring or the like 174 in a generally counterclockwise direction about a pivot pin or shaft 176 which extends through and functions to operatively support the arm 170. The spring 174 normally functions to ension the brake band 166 such that the same will be forced into frictional engagement with one or more resilient friction rings or the like 178 carried around the outer periphery of the disc 164, thereby positively preventing rotation of the rotor 164 and hence rotation of the drive shaft 146 and rotor 114; however, at such time as the motor 150 is energized, the solenoid 172 is intended to be simultaneously energized, which results in clockwise pivotal movement of the arm 170 about the pivot pin 176, whereupon the end of the arm 170 opposite the solenoid 172 will move downwardly in FIG. 8 against the resistance of the spring 74, thereby reducing the tension on the brake band 166 and thus permitting rotation of the disc 164, drive shaft 146 and rotor 114. At some predetermined time during the operational cycle of the machine 10, both the motor 150 and solenoid 172 will become deenergized, whereupon the arm 170 will be biased again in a counterclockwise direction under the influence of the spring 174 and thus the brake band 166 will be forced into frictional engagement with the disc 164 to prevent further rotational movement thereof.

The means for selectively controlling timed rotation of the rotor 114 is best shown in FIG. 8 and is shown as comprising a cam disc, generally designated by the numeral 180, which is rotatably carried upon the end of the shaft 146 opposite the rotor 114 and is adapted to rotate concomitantly with the rotor 114. The cam disc 180 is formed with a peripheral slot or notch 182 which is cooperative with a follower cam 184 of an electrical control switch, generally designated by the numeral 186. The notch or recess 182 in the disc 180 is rotatably positioned relative to the rotational position of the rotor 114 such that the notch 182 is engaged or registers with the follower arm 184 of the control switch 186 when the scoop area 130 of the rotor 114 is in the approximately ten o'clock position in FIG. 2. At such time as a vend cycle is desired, the drive motor 150 will be energized, as will solenoid 172, whereupon the rotor 114 will rotate in a counterclockwise direction in FIG. 2 and the scoop area 130 thereof will eventually move through the quantity of ice stored within the lower end of the bin 100. The scoop area 130 will fill with ice as it passes through the quantity of cubes and the rotor 114 will continue to rotate until the scoop area 130 is in the 12 o'clock position shown in FIG. 2, whereupon the cubes within the scoop area 130 will fall through the opening 158 and delivery conduit 160. The rotor 114 will continue to rotate until the scoop area 130 again reaches the approximately 10 o'clock position in FIG. 2, at which time notch 182 will again move into contact with the follower arm 184 of the switch 186 which results in deenergization of the drive motor 150 and solenoid 172, thus terminating the vend cycle.

Figure 10:
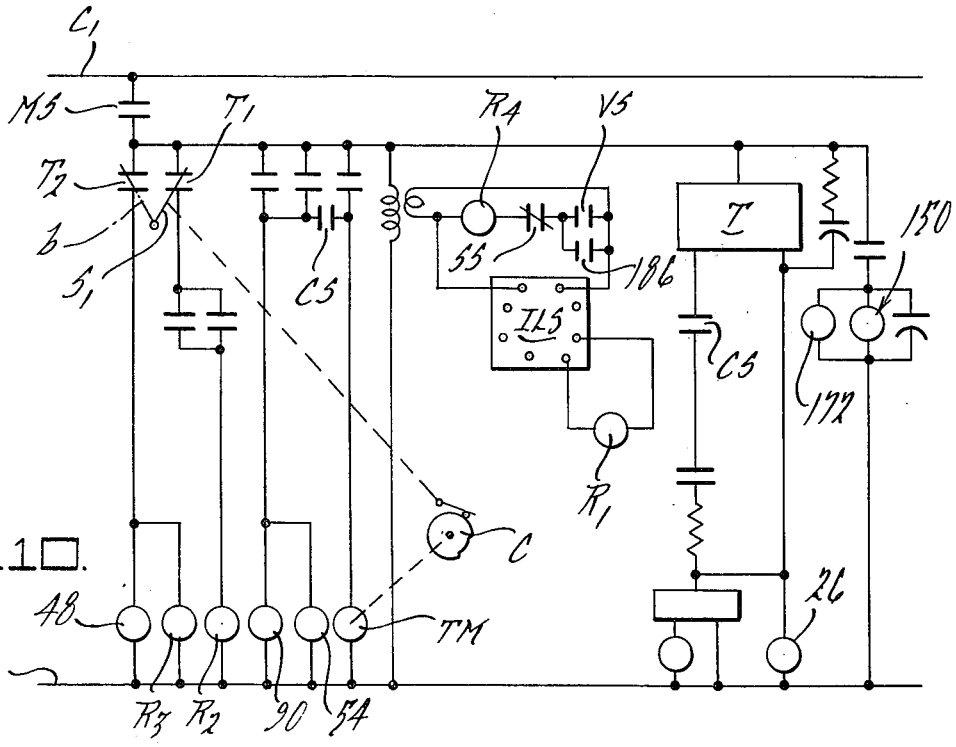
FIG. 10 is a schematic representation of the electrical control circuit embodied in the ice making and vending machine of the present invention.

Referring now in detail to FIG. 10 wherein a schematic representation of the electrical control circuit of the machine 10 is depicted, said system includes a motor driven timer switch S, for example, of the type shown in Roberts U.S. Pat. No. 2,949,091, which includes a timer motor TM which functions to drive a notched cam C. The cam C, throughout the freezing cycle of the refrigeration system 24 holds a switch blade *b* in engagement with a normally closed timer contact T1. At the end of the freezing cycle, the blade *b* drops into a notch in the cam which permits the blade *b* to move into engagement with normally open contact T2. Closure of contact T2 energizes the solenoid valve assembly 48 at the beginning of the harvest portion of the cycle. At the end of the harvest period, the cam follower rides out of the notch in the cam C, re-opening contact T2 and re-closing contact T1, thus terminating the harvest period. The electrical system of the machine 10 includes three primary relays identified as R1, R2 and R3 in FIG. 10. The relay R1 is cooperative with an ice level sensing mechanism ILS, the details of which are described in U.S. Pat. No. 3,911,691 and which generally functions to sense the level of the ice within the ice storage bin 100. Energization of the relay R2 is adapted to actuate the spray bar motor 90 and the water pump 54, while the relay R3 functions to bypass the ice level sensing mechanism ILS during the freezing cycle so that the sensing mechanism cannot call for additional ice during the course of the freezing cycle.

It is believed that the details of the control system can best be understood from a description of the operation thereof. Assuming that the electrical system is connected to a suitable source of line voltage by primary conductors C1 and C2 and further assuming that the master switch MS and compressor switch CS are closed, electrical energy is supplied via a bi-directional triad thyristor (triac) T to the motor of compressor 26. The starting and running circuits for the compressor motor, as well as the motor itself may be entirely conventional and hence are not described in detail. As appreciated by those skilled in the art, starting of the compressor initiates the freezing portion of the cycle. Through energization of the relay R2, the spray bar motor 90 is energized as is the water pump 54, which results in water being sprayed upwardly into the plurality of inverted molds 80. When the formation of the ice cubes has progressed to a predetermined degree, a cube size control device CS such as an evaporator control or the like, will initiate operation of the timer motor TM, after which time the freezing portion of the cycle will be terminated and the harvest portion thereof will be initiated. More particularly, upon rotation of the timer rotor cam, the timer blade *b* will separate from the contact T2 and re-engage contact T1 which results in de-energization of the compressor running circuit and opening of the circuit via the relay R2 to the spray bar motor 90 and water pump 54. Engagement of the timer blade *b* with contact T1 also effects actuation of the solenoid water valve 48 which, as previously described, results in water previously warmed in the water tank 42 being communicated to the platen 60. During the harvest period, the timer motor TM continues to drive its cam and ultimately causes the cam follower to ride out of the cam notch, resulting in re-opening of contact T1 and re-closing of contact T2. Assuming that the ice level control mechanism ILS is not calling for additional ice, the machine will remain idle until such ice is called for, at which time a complete freezing and harvest cycle as previously described will be completed.

The machine 10 is provided with a manually engageable electrical control or vend switch, generally designated VS which is adapted to be actuated to initiate a vend cycle. When this switch VS is actuated, a circuit is completed to the drive motor 150 and concomitantly, the brake solenoid 172 is energized via another relay R4. Accordingly, the rotor 114 will begin to rotate causing the scoop area or portion 130 thereof to be moved through the ice within the bin 100 and at the same time, the cam follower arm 184 will bear against the periphery of the rotating cam disc 180. The switch 186 associated with the follower arm 184 closes a circuit to the brake solenoid 172 and drive motor 150 when the arm 184 is not registered with the notch 182. At such time as the cam disc 180 rotates a sufficient amount (approximately one revolution), the follower arm 184 will move into the notch 182 on the disc 180, thereby opening the aforesaid circuit and establishing de-energization of the brake solenoid 172 and gear motor 150. As previously described, the ice which is carried in the rotor 114 is deposited into the chute 160 as the opening 134 in the rotor 114 moves into registry with the opening 158 of the bin side section 108. Also, as will hereinafter be described, an ice door safety switch SS is normally in a closed position; however, in the event the ice delivery door in the cavity 16 is opened, the switch SS will be actuated to open the circuit to the relay R4, thus terminating the vend cycle.

Referring now in detail to FIG. 7, the forward end of the ice delivery chute 160 will be seen to terminate in an opening 200 formed in the front face 14 of the housing 12 at an upper end section 202 of the dispensing cavity 16. Disposed directly in front of the opening 200 and hence in front of the ice discharge chute 160 is an ice delivery door, generally designated by the numeral 204, which is provided with a forward side 206 having a manually graspable handle 208. The door 204 is preferably fabricated of an injection molded transparent plastic material to enable an operator to observe the presence of ice cubes that have been delivered from the chute 160 into a cavity 210 defined between the rearward side of the door 204 and the opening 200. The door 204 is mounted for vertical reciprocation by means of a pair of guideways or the like 212 located at the laterally opposite sides of the door 204, and further by means of a pair of guide pins at the upper end of the door 204, one of which pins is shown in FIG. 7 and generally designated by the numeral 214. The guide pins 214 and guideways 212 function to permit the door 204 to be moved from the solid line position shown in FIG. 7 toward a lowered phantom-line position in this figure, which in turn permits ice cubes to be dispensed from the cavity 210 into a container or the like which the operator places within the lower end of the dispensing cavity 16. Suitable spring means, as designated at 216, is provided to resiliently maintain the door 204 in the solid line position in FIG. 7, which spring means is adapted to resiliently yield to permit downward movement of the door 204 during an ice dispensing operation. Disposed adjacent the lower end of the door 204 is a pivotable closure element or plate 218 which normally assumes the solid line position in FIG. 7 extending between the forward side of the dispensing cavity 16 and the inner side of the door 204. As will be apparent, the plate 218 functions to retain ice cubes within the cavity 210 prior to the operator moving the door 204 downward to effect dispensing of the ice. Cooperable guideway means is provided interjacent the laterally opposite sides of the plate 218 and the adjacent sides of the door 204, whereby downward movement of the door 204 results in the plate 218 being pivoted from its normal horizontal position in a generally clockwise direction in FIG. 7 toward the phantom-line vertical position in this figure. As will be appreciated by those skilled in the art, at such time as the plate 218 is thus pivoted from its horizontal position to a generally vertical position, the ice cubes within the cavity 210 will drop downwardly under the influence of gravity into any suitable receptacle placed thereunder. At such time as the supply of ice within the cavity 210 has been thus dispensed, the handle 208 may be released and the door 204 will be biased upwardly under the influence of the spring 216, which in turn results in counterclockwise pivotal movement of the plate 218 to close the lower end of the cavity 210 preparatory to the next delivery of ice cubes thereinto from the rotor 114.

Disposed adjacent the upper end of the door 204 is a door safety switch, representatively designated by the numeral 220 in FIG. 7 which includes an actuating arm 222 adapted to be selectively engaged, for example, by one of the guide pins or the like 214 upon downward movement of the door 204. As previously mentioned, the switch 220 is connected in the electric circuit to the drive motor 150 so that when the arm 222 is actuated upon downward movement of the door 204, the circuit to the motor 150 is opened to effect de-energization thereof. Accordingly, the motor 150 is temporarily rendered inoperative so that the motor 114 cannot deliver additional ice cubes to the cavity 210 during such time as the door 204 is lowered, i.e., during and ice dispensing operation. At such time as the door 204 is again raised to its normal position shown in FIG. 7 at the end of a dispensing operation, the switch 220 will be actuated so as to close the electrical circuit to the motor 150 to permit normal delivery of the ice cubes via the rotor 114 upon actuation of the vend switch described in electrical circuitry of the machine 10.

The lower end of the dispensing cavity 216 is formed with a drain opening 224 over which a suitable support grate or the like 226 is located. The opening 224 is communicable with a suitable drain fitting or the like 228 which is in turn communicable with a drain conduit 230, the lower end of which may be connected to the same outside drain for the machine 10 as the drain 96 associated with the solenoid water valve 48. Alternatively, the drain conduit 230 and the drain 96 may be communicable with a common drain pan or the like located interiorly of the housing 12 in a manner well known in the art.

Figures 8, 9:
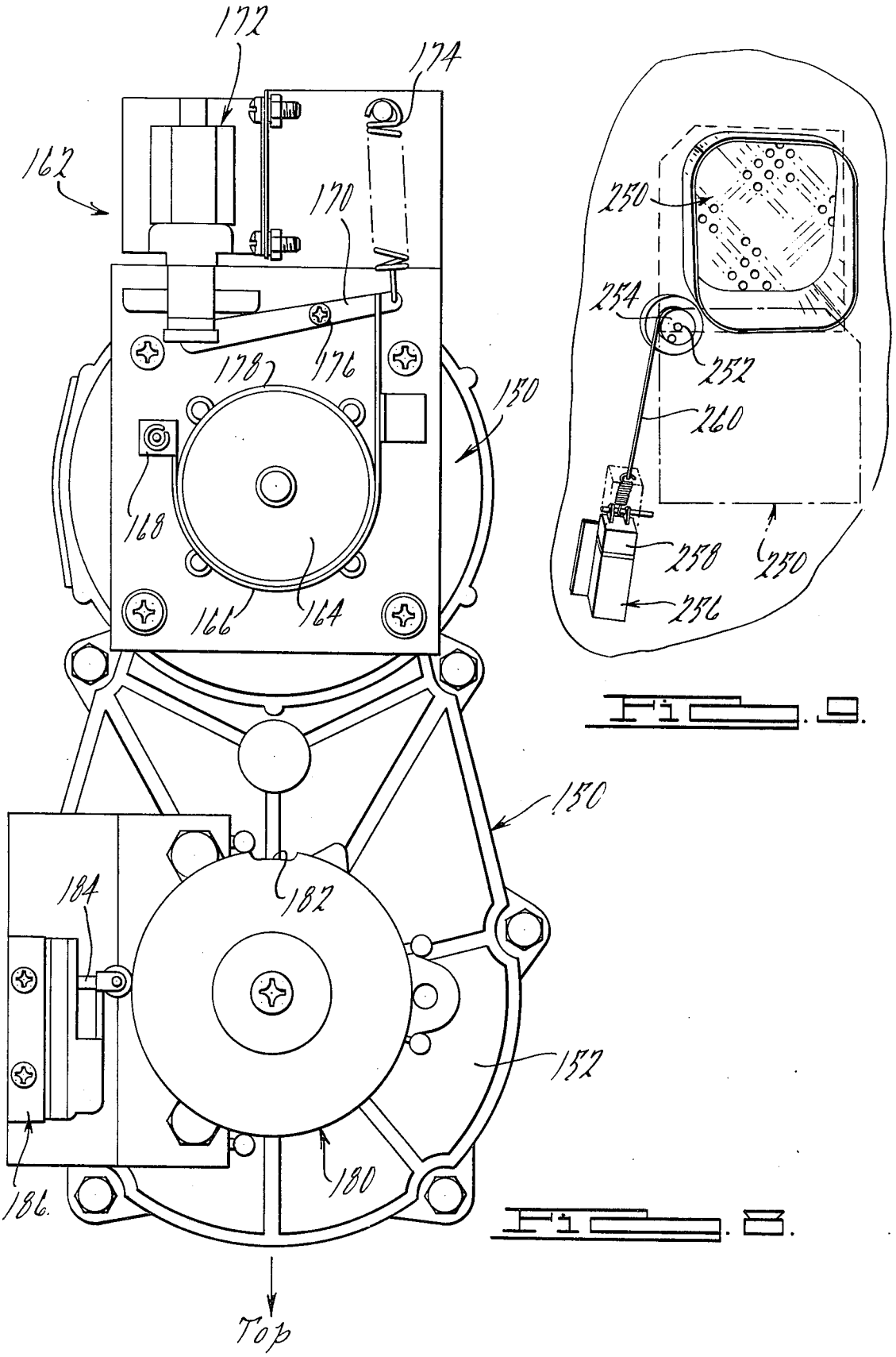
FIG. 9 is an enlarged side elevational view of a shutter mechanism which may be optionally provided on the ice making and vending machine of the present invention.

For certain types of applications, such as when the machine 10 is installed where considerable time passes between vend operations, it may be desirable to periodically effect agitation of the ice cubes within the bin 100 irrespective of the fact that bridging of the ice cubes normally stored therein will be minimized to the extreme by virtue of the size and shape of the bin 100 and the rotor 114 located in the lower end thereof. One particularly advantageous way of effecting such ice cube agitation is to periodically rotate the rotor 114 which, by virtue of its orientation within the bin 100, will move or rotate within the lower end of the mass of cubes stored within the bin 100 and hence effect sufficient movement or stirring thereof to prevent ice fusing. One problem, however, results in the use of the rotor 114 in effecting ice agitation and that resides in the fact that it is necessary to provide some means for preventing ice cubes from being transmitted or conveyed from the scoop area 130 of the rotor 114 through the ice chute 160 during an agitating cycle. In accordance with the principles of the present invention, one exemplary means is depicted in FIG. 9 for preventing undesired transmission of ice cubes from the bin 100 into the cavity 210 of the door 204 during an ice agitating cycle. Such means is in the form of a pivotable shutter element, generally designated by the numeral 250, which is adapted to be selectively moved between a position permitting ice cube flow through the chute 160 to a position blocking such ice cube flow. More particularly, the shutter element 250 is in the form of a generally flat, rectangular plate, that may or may not be perforated, and which is somewhat larger in size than the cross-sectional size of the chute 160. The shutter element 250 is pivotably mounted by means of a suitable pivot shaft or the like 252 adjacent one corner thereof. The shaft is suitably journal supported at one end of the chute 160 and is adapted to effect rotational movement of the element 250 from the lowermost phatom-line position in FIG. 9 to the uppermost phantom-line position in this figure. More particularly, the shaft 252 is journal supported adjacent or within the inclined wall section 108 of the bin 100 in a manner such that the shutter element 250 is pivotably interjacent the under side of the rotor 114 and the confronting side of the section 108. The shaft 252 preferably extends through the side section 108 and is provided with a suitable pulley or sheave 254 on the end thereof which is on the opposite side of the side section 108 from the rotor 114. Disposed below the sheave 254 is an electrically energized solenoid mechanism, generally designated 256, which includes an actuatable armature 258 on the upper side thereof, the armature 258 being movable between the solid and phantom-line positions in FIG. 9 in response to a suitable electrical signal communicated to the solenoid 256. The armature 258 is connected to sheave 254 by means of a flexible cable or the like 260, the lower end of which is spring tensioned at its connection to the armature 258, as illustrated. The diameter of the sheave 254 and operative stroke of the armature 258 are correlated such that when the armature moves from the phantom-line position in FIG. 9 to the solid-line position in the figure, the sheave 254 will be rotated in a counterclockwise direction in this figure, resulting in counterclockwise pivotal movement of the shutter element 250 from its lower phantom position to its uppermost phantom position. As will be appreciated, the armature 258 is normally disposed in the phantom-line position in FIG. 9, while the shutter element 250 is normally oriented in the lowermost phantom-line position in this figure. At such time as it is desired to effect agitation of the ice within the bin 100 by means of the rotor 114, a suitable electrical signal can be communicated to the solenoid 256, resulting in downward movement of the armature 258 from the phantom position to the solid-line position. When this occurs, the shutter element 250 will be pivoted in a counterclockwise direction as a result of counterclockwise rotation of the shaft 252 and sheave 254, resulting in the element 250 being moved from the lower phantom position to the upper phantom position where the element 250 will function to prevent ice from being communicated from the scoop area 130 of the rotor 114 into the chute 160. At such time as the agitation cycle is terminated, the solenoid 256 may be deactuated, resulting in the armature 258 being moved upwardly to the phantom-line position in FIG. 9, which in turn results in the shutter element 250 being pivoted in a clockwise direction about the axis of the shaft 250 from the upper phantom position to the lower phantom position to again permit ice to be transmitted through the chute 160. It will be noted that while the shutter element 250 is depicted as being located adjacent the inlet end of the chute 160, for certain application, the element could be located at various other locations without affecting its ability to positively prevent the transmission of ice cubes into the cavity 210 of the door 204 during an agitation cycle.

It will be seen from the foregoing description that the present invention provides a new and improved ice making and vending machine which overcomes a number of the objectionable characteristics of similar type machines known in the prior art. In particular, the ice making and vending machine 10 of the present invention will be seen to minimize to the extreme any ice bridging of fusing within the ice storage bin by virtue of the unique design and relationship of the bin rotor 114 to the configuration of the bin 100. Additionally, the ice making and vending machine of the present invention will be seen to be extremely positive in operation in assuring that ice cubes are not delivered to the dispensing cavity of the machine housing except during such time as the vend switch is actuated, with the brake arrangement associated with the drive motor 150 functioning to positively position the rotor 114 at the termination of each vend cycle. It will be noted that the brake mechanism will function in two directions so as to not only prevent forward rotation of the rotor 114 at the termination of a vend cycle but will also prevent rearward rotation as might occur when the rotor 114 is subjected to certain loading conditions due to the quantity and orientation of the cubes within the bin 100. Still another feature of the present invention resides in the fact that in those instances when supplemental ice agitation is desired, a unique shutter arrangement may be employed so as to permit such agitation to be achieved by means of the ice dispensing rotor 114, thereby obviating the need for any ancillary ice agitating equipment as has occasionally been required in the art. Still another feature of the present invention resides in the fact that the entire ice storage bin may be economically fabricated of an easily moldable snythetic polymeric material, such as plastic, which provides for the requisite sanitary conditions within the bin and permits ease of assembly through the use of a unitized bin structure. Additionally, the ice making and vending machine will be seen to be adapted for a wide variety of different types of uses or installations and hence will find universality of application.

When it will be apparent that the preferred embodiments herein illustrated are well calculated to fulfill the objects stated above, it will be appreciated that the present invention is susceptible to modification, variation, and change without departing from the scope of the invention.

We claim:

1. In an ice cube vending machine, a housing including an ice cube dispensing area, ice storage bin means within said housing and providing an ice cube storage area for ice cubes to be dispensed at said dispensing area, means providing an ice transfer path between said storage and dispensing areas, a rotatable ice transfer drum means within said storage area for selectively conveying ice cubes toward said transfer path, a first electrically energized motor means for selectively rotating said drum, a pivotally mounted shutter element located adjacent said path and movable between a first position substantially out of registry with said path thereby permitting relatively unobstructed movement of ice along said path, and a second position substantially in registry with said path so as to at least limit movement of ice along said path, a second electrically energized motor means operatively connected to said shutter element for causing selective pivotal movement of said element, and control means for operating said first motor means independently of said second motor means in a first mode of operation of said machine and for operating both said first and said second motor means in a second mode of operation of said machine.

2. The invention as set forth in claim 1 which includes brake means operable in a first condition to resist movement of said ice transfer means and actuatable to a second condition to permit selective movement of said transfer means, with said brake means normally being in said first condition and being actuatable to said second condition concurrently with operation of said transfer means.

3. The invention as set forth in claim 1 wherein said ice storage bin includes a pair of laterally-spaced vertically extending side walls, an upwardly inclined wall extending between said side walls and a generally arcuate-shaped bottom wall cooperating with said inclined and side walls in defining the lower end of said ice storage area, said bottom wall in part being defined by an imaginary circle whose center is coincident with a location on said inclined wall where said ice transfer means is rotatably mounted.

4. The invention as set forth in claim 1 wherein said pivotally mounted shutter substantially blocks said path when in said second position so as to prevent movement of ice along said path.

5. In an ice cube vending machine, a housing including an ice cube dispensing area, ice storage bin means within said housing and providing an ice cube storage area for ice cubes to be dispensed at said dispensing area, means providing an ice transfer path between said storage and dispensing areas, ice transfer means within said storage area for selectively conveying ice cubes toward said transfer path, a transposable element comprising a pivotably mounted shutter movable between a first position substantially out of registry with said path thereby permitting relatively unobstructed movement of ice along said path, and a second position substantially blocking said path so as to prevent movement of ice along side path, means pivotably supporting said shutter comprising a shaft and means for selectively rotating said shaft, said means for rotating said shaft including an electrically energizable solenoid and a flexible cable operatively connecting said solenoid with said shaft whereby actuation of said solenoid effects selective rotation of said shaft, control means for operating said ice transfer means independently of said last mentioned means in a first mode of operation of said machine and for operating said ice transfer means and last mentioned means in a second mode of operation of said machine, said control means including means responsive to an electrical signal for selectively rotating said shutter to and from a position blocking said path.

6. The invention as set forth in claim 5 wherein said transfer means comprises a rotatable drum.

7. The invention as set forth in claim 6 wherein said drum is formed with an opening which is selectively registratable upon rotation of said drum with an opening in said bin whereby ice cubes may be transferred from said bin along said path.

8. The invention as set forth in claim 7 which includes electrical energized drive motor for selectively rotating said drum and wherein said solenoid is selectively actuatable concomitantly with energization of said drive motor.

* * * * *